US007290404B2

(12) United States Patent
Kearnes et al.

(10) Patent No.: US 7,290,404 B2
(45) Date of Patent: Nov. 6, 2007

(54) GEMSTONE MATERIAL

(75) Inventors: Ronald H. Kearnes, Rochester, MN (US); Steven F. Starcke, Rochester, MN (US); Keven E. Bennet, Rochester, MN (US)

(73) Assignee: Azotic Coating Technology, Inc., Rochester, MN (US)

( * ) Notice: Subject to any disclaimer, the term of this patent is extended or adjusted under 35 U.S.C. 154(b) by 574 days.

(21) Appl. No.: 10/618,959

(22) Filed: Jul. 14, 2003

(65) Prior Publication Data

US 2005/0011225 A1 Jan. 20, 2005

(51) Int. Cl.
*C03C 27/00* (2006.01)
*A44C 17/00* (2006.01)
*A44C 27/00* (2006.01)

(52) U.S. Cl. ..... 65/43; 63/32; 65/36

(58) Field of Classification Search ..... 63/32; 65/43, 36, DIG. 11
See application file for complete search history.

(56) References Cited

U.S. PATENT DOCUMENTS

| | | | | |
|---|---|---|---|---|
| 2,115,409 | A * | 4/1938 | Casto | 428/203 |
| 2,115,433 | A * | 4/1938 | Soule | 428/204 |
| 2,535,807 | A | 12/1950 | Moyd | 63/32 |
| 2,948,082 | A | 8/1960 | Watson | 49/78.1 |
| 3,581,522 | A | 6/1971 | Wincklhofer et al. | 63/32 |
| 3,742,731 | A | 7/1973 | Phillips et al. | 63/32 |
| 3,864,939 | A | 2/1975 | Phillips et al. | 63/32 |
| 4,030,317 | A | 6/1977 | Rogell | 63/32 |
| 4,039,726 | A | 8/1977 | Carr et al. | 428/539 |
| 5,208,080 | A * | 5/1993 | Gajewski et al. | 428/1.54 |
| 5,424,119 | A * | 6/1995 | Phillips et al. | 428/328 |
| 5,853,826 | A | 12/1998 | Starcke et al. | 428/15 |
| 6,197,428 | B1 | 3/2001 | Rogers | 428/446 |
| 6,749,936 | B2 * | 6/2004 | Argoitia et al. | 428/402 |
| 2003/0014998 | A1 * | 1/2003 | Cabo | 65/43 |

OTHER PUBLICATIONS

Paolo CHiggiato, TS-MME, Coatings, Chemistry and Surfaces CERN, CH-1211 Geneva 23, "Outgassing, CAS: Presentation 2006", pp. 1-81 (http://cas.web.cern.ch/cas/Spain-2006/PDFs/Chiggiato-1.pdf) ; Website accessed Jun. 28, 2006.*

Overview of shear induced stress and spin coating (http://web.archive.org/web/20020816181713/http://www.compliantlab.sdsmt.edu/awlad/introduction.htm) ; Website accessed Jun. 28, 2006.*

* cited by examiner

*Primary Examiner*—Steven P. Griffin
*Assistant Examiner*—Jason L. Lazorcik
(74) *Attorney, Agent, or Firm*—Fredrikson & Byron, P.A.

(57) ABSTRACT

The invention provides a gemstone material having therein embedded a plurality of dichroic particles. Methods of producing the gemstone material are also provided. The gemstone material can be provided in the form of a slab, faceted gemstone, or cabochon.

25 Claims, 6 Drawing Sheets

GEMSTONE MATERIAL

FIELD OF THE INVENTION

The present invention provides an article useful as a gemstone or decorative object and methods of making such an article. More particularly, this invention provides a gemstone material incorporating dichroic particles and methods of making such gemstone material.

BACKGROUND OF THE INVENTION

Certain natural stones, such as opal, have long been valued for the beautiful play-of-color they exhibit. These stones possess internal structures having a modulated index of refraction, absorption, or other optical parameter. The index of refraction or other optical parameter is modulated on the scale of wavelengths of visible radiation (i.e., light) and thus produces color by interference. This interference is wavelength and angle dependant so the stone appears to change color with the observer's viewpoint. Stones of this nature are commonly cut and polished to produce gemstones and other decorative articles. Examples of such stones include opal, fire obsidian, mother of pearl, and fire agate. Of these, opal is perhaps the most highly coveted.

There are three basic types of opal: (1) common opal; (2) fire opal, and; (3) precious opal. Common opal (i.e., potch) is the least valuable because it has no play-of-color. Common opal comes in white, grey, yellow, blue, green, and pink. Fire opal is named for its fiery red color. It ranges from a deep red to shades of orange and yellow. Fire opal is more valuable than common opal because of its coloring. Precious opal (i.e., gem opal) exhibits a coveted play-of-color and thus is quite valuable. Precious opal comes in a wide range of colors. Precious opals that are predominantly white or light blue are the most common, while those containing red, orange, or violet are more rare. Black opal (opal having a predominantly dark background) is the rarest and perhaps the most desired of the different types of opal.

All the different types of natural opal have the same chemical composition. Specifically, opal is characterized by silica having therein incorporated water molecules. Whether opal exhibits a play-of-color does not depend on there being any inclusion in the stone. Rather, this depends on the arrangement of silica spheres and water molecules. In cases where the silica spheres are of uniform size and arrangement (e.g., arranged in octahedrons), the light reflecting from them is split into spectral colors, and the stone appears to contain all the colors of the rainbow. In cases where the silica spheres are large or less uniformly arranged, the color range is minimal or non-existent.

Opal has been chemically duplicated in the laboratory. This opal is commonly referred to as synthetic opal. Synthetic opal is an artificially-made material that has the same composition and structure as its natural counterpart. A variety of methods are currently used to produce synthetic opal.

In addition to synthetic opal, attempts have been made to create simulated opals. Simulated opals are artificially-made materials that are similar in appearance to natural opal, but have different optical, physical, and/or chemical properties. One simulated opal type is known as Slocum Stone, a material produced years ago by an individual named John Slocum. The process used for making Slocum Stone was always kept secret. However, it is postulated that Slocum Stone was produced by a process similar to that used in producing dichroic glass beads and cabochons. For example, Slocum Stone specimens are known to contain air bubbles and randomly-oriented flecks of dichroic color, which are also characteristics of dichroic glass beads and cabochons.

Methods of making dichroic glass beads and cabochons (i.e., cabs) are known. Typically, these methods involve fusing together alternating sheets of dichroic-coated glass (i.e., glass bearing a dichroic coating) and uncoated glass. For example, dichroic-coated glass is commonly sandwiched between uncoated glass, and the resulting laminate is then fused in air (e.g., in a furnace) for several hours. During fusing, the dichroic film ruptures and curls. This rupturing is caused by sagging of the glass under the inflexible dichroic film. Because this rupturing is inherently random, a relatively small percentage of the resulting material is usable for gemstones. Moreover, a specific gemstone appearance cannot be consistently reproduced by this method due to the randomness of the film rupturing. Further, this process traps a significant amount of air between the glass sheets, leaving air bubbles in the resulting material. These bubbles diffract light in a gemstone formed from such material, creating murkiness and spots that detract from the appearance of the gemstone.

The processes used to produce Slocum Stone, dichroic glass beads and cabs, and various other materials are referenced below in Table 1. As noted above, the process used to produce Slocum Stone was always kept secret, and therefore the notes in Table 1 concerning Slocum Stone reflect the process the present inventors surmise was used to produce this material.

TABLE 1

| Process | Form silica micro-spheres | Precipitate silica into pseudo-crystal | Impregnation | Coat dichroic onto substrate | Crush dichroic | Fuse or sinter at high temperature | Polymerize plastic at low temperature | Fabricate into gem (lapidary) |
|---|---|---|---|---|---|---|---|---|
| Slocum Stone | No | No | No | Yes | No | Fuse in air | No | Yes |
| Dichroic glass beads and cabs | No | No | No | Yes | No | Fuse in air | No | No |
| Imitation opal (plastic base) | Yes | Yes | Yes plastic | No | No | No | Yes | Yes |

TABLE 1-continued

| Process | Form silica micro-spheres | Precipitate silica into pseudo-crystal | Impregnation | Coat dichroic onto substrate | Crush dichroic | Fuse or sinter at high temperature | Polymerize plastic at low temperature | Fabricate into gem (lapidary) |
|---|---|---|---|---|---|---|---|---|
| Synthetic opal (silica base) | Yes | Yes | Yes silica | No | No | Sinter in air | No | Yes |
| Simulated mother of pearl | No | No | mica in plastic | No | No | No | Yes | Yes |
| Goldstone | No | No | copper + carbon | No | No | Yes fuse | No | Yes |

Numerous characteristics are considered to be desirable in a gemstone material. These characteristics include opal simulation, absence of air bubbles, color uniformity, color range, opalescence, color orientation, color layering, durability, and facetability. Regardless of the particular combination of these properties that is desired, low production cost is always preferred.

Various attempts have been made to produce synthetic and simulated gemstone materials that can achieve certain combinations of these characteristics. Unfortunately, no existing material has achieved all of these characteristics. Some existing materials are produced by complicated, expensive methods. For example, Slocum Stone and synthetic opal would be considered high cost materials. Those materials that are made by less complicated and/or costly methods tend to be limited in terms of their properties. This is borne out below in Table 2.

TABLE 2

| Material | Cost | Durability | Opal simulation | Air bubbles | Color uniformity | Base color | Facetable | Opalescence | Color Orientation | Color layering |
|---|---|---|---|---|---|---|---|---|---|---|
| Slocum Stone | High | Good | Fair-Good | Some-Many | Poor | None | No | No | Yes | No |
| Dichroic glass beads and cabs | Low-Moderate | Good | Fair-Good | Many | Poor | Any | No | No | Yes | No |
| Imitation opal (plastic base) | Low | Poor | Near-Perfect | None | Excellent | Pastel to Black | Yes | Yes | Yes | Yes |
| Synthetic opal (silica base) | High | Very Good | Near-Perfect | None | Excellent | Pastel to Black | Yes | Yes | Yes | Yes |
| Simulated mother of pearl | Low | Poor | Poor-Fair | None-Few | Good | Pastel to Black | No | Yes | Yes or No | No |
| Goldstone | Moderate | Good | Not Applicable | Some | Excellent | Several | No | No | No | No |

It would be desirable to produce a gemstone material that resembles opal or another natural gemstone. For example, it would be desirable to produce a gemstone material having therein embedded dichroic particles. It would be particularly desirable to provide such a gemstone material wherein the dichroic particles are substantially uniformly oriented. It would also be particularly desirable to provide such a gemstone material wherein the dichroic particles are present in a certain size distribution. Further, it would be particularly desirable to provide a gemstone material that comprises dichroic particles and is substantially free of air bubbles. Still further, it would be desirable to provide a gemstone material that can achieve any combination of desirable gemstone characteristics. It would be particularly desirable to provide a gemstone material of this nature that can be produced at low cost.

SUMMARY OF THE INVENTION

Figure 1:
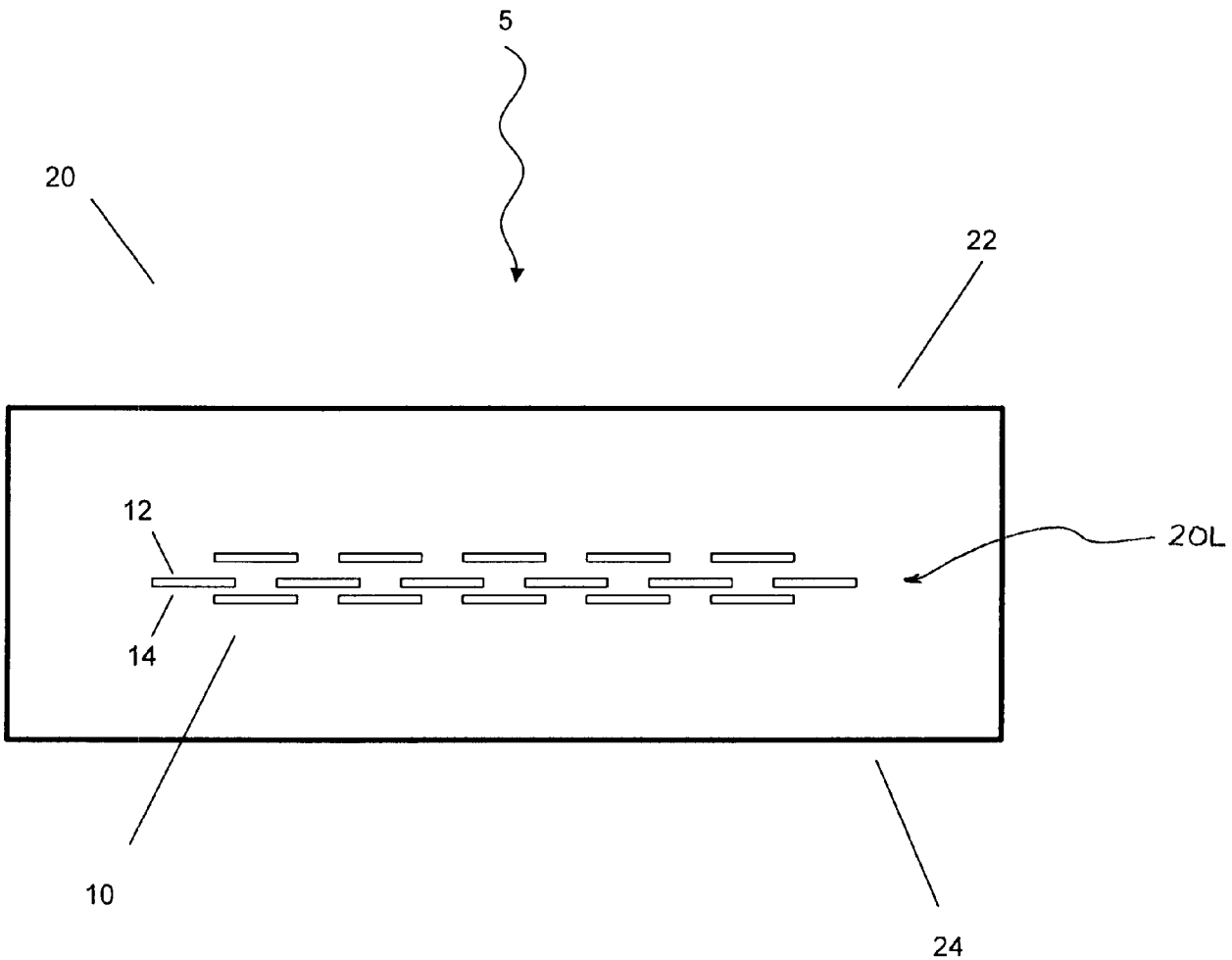
FIG. 1 is a schematic side illustration of the gemstone material of the present invention in the form of a slab in accordance with certain embodiments.

In certain embodiments, the invention provides a gemstone material comprising a vitreous material in which a plurality of dichroic particles are embedded. In these embodiments, the dichroic particles are arranged in a substantially uniform orientation.

In certain embodiments, the invention provides a method of producing gemstone material. The method includes providing a laminate comprising a plurality of dichroic particles sandwiched between two sheet-like substrates. The method also includes heating the laminate to an elevated temperature such that the plurality of dichroic particles become fused between the sheet-like substrates.

In certain embodiments, the invention provides a method of producing gemstone material. The method comprises providing two sheet-like substrates and a plurality of dichroic particles. The method also includes separating t least some of the dichroic particles into different groups characterized by different particle size ranges. At least some particles from the different groups are then separated in a desired particle size distribution to produce size-classified particles. A plurality of the size-classified particles are positioned between the two sheet-like substrates to form a laminate. The laminate is heated to an elevated temperature such that this plurality of the size-classified particles become fused between the sheet-like substrates.

In certain embodiments, the invention provides a gemstone material comprising a vitreous material in which a plurality of dichroic particles are embedded. In the present embodiments, the gemstone material is substantially free of air bubbles.

In certain embodiments, the invention provides a gemstone material comprising a vitreous material in which a plurality of dichroic particles are embedded. In the present embodiments, the embedded dichroic particles are present in a repeatable particle size distribution.

DETAILED DESCRIPTION OF PREFERRED EMBODIMENTS

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

The present invention provides a gemstone material incorporating dichroic particles and methods of making such gemstone material. It is desirable to incorporate dichroic particles into a gemstone because the particles create a play-of-color that is characteristic of many natural gemstones, such as precious opal. Preferably, the gemstone material appears to the naked eye to change color with changing angles of observations. In more detail, at least some of the dichroic particles in the gemstone material preferably appear to the naked eye to change color with changing angles of observation, such that the gemstone material exhibits a play-of-color.

In certain preferred embodiments, the embedded dichroic particles are arranged (e.g., disposed) in a substantially uniform orientation. This provides maximum brilliance and an exceptional play-of-color. This is a major improvement over Slocum Stone, dichroic glass, and other materials that characteristically have un-oriented particles. The present inventors have discovered that un-oriented particles can give gemstone material an undesirably murky appearance, especially in faceted gemstones.

In certain preferred embodiments, the gemstone is substantially free of air bubbles. This is another major improvement over Slocum Stone, dichroic glass, and other materials that characteristically have air bubbles. Air bubbles in a gemstone diffract light in the stone, creating murkiness that is readily visible to the naked eye and detracts from the appearance of the stone. The present gemstone material can be consistently produced with substantially no air bubbles, such that the material is free of murkiness that is readily visible to the naked eye. Certain favored methods of the invention are advantageous in this respect, as they involve collapsing air bubbles that would otherwise yield murkiness. Unlike such materials, the present gemstone material In certain preferred embodiments, the dichroic particles are present in the gemstone material in a repeatable particle size distribution. This allows the gemstone material to be produced on a repeatable, reproducible basis. This is yet another major improvement over Slocum Stone, dichroic glass, and other materials characteristically having particles that are not in any specific size distribution. This feature allows the present gemstone material to be fashioned into a plurality of products each having the same general appearance and yet each being unique.

The present gemstone material also has very good durability and excellent color uniformity. Moreover, this gemstone material can achieve all (or any combination) of the desirable characteristics noted below in Table 3.

TABLE 3

| Material | Cost | Durability | Opal simulation | Air bubbles | Color uniformity | Base color | Facetable | Opalescence | Color Orientation | Color layering |
|---|---|---|---|---|---|---|---|---|---|---|
| Gemstone material of the present invention | Low | Very Good | Good-Excellent | None | Excellent | Any | Yes | Yes | Yes | Yes |

Preferably, the dichroic particles are embedded in a vitreous material. The vitreous material typically comprises a glass or crystal material. Glass and crystal materials are advantageous because, for example, they tend to be particularly durable. Moreover, glass and crystal can be acquired and/or produced at relatively low cost. Fusible glass or crystal material is preferred. Useful fusible glass is commercially available from Bullseye Glass Company, which is located in Portland, Oreg., U.S.A. Clear fusible glass is used in certain embodiments. The vitreous material can also comprise plastic or the like. For example, the dichroic particles can be embedded in a matrix comprising various polymers, plastic resins, etc. In certain embodiments, the dichroic coating is deposited upon a polymer film (e.g., a polyester film) and incorporated into a polyester resin matrix. Other suitable matrix materials will be apparent to skilled artisans given the present teaching as a guide.

The dichroic particles in the present gemstone material can comprise any material having dichroic properties. Typically, the dichroic particles comprise particles (e.g., flakes) of dichroic film. Such film particles commonly have two generally-opposed major surfaces 12, 14. Dichroic coatings are well known in the present art. They typically comprise at least one dielectric layer (of a metal oxide, metal nitride, etc.). Commonly, dichroic coatings comprise a stack of thin dielectric layers. In some cases, these film stacks comprise alternating layers of different dielectric materials (such that each layer is formed of a material different than each layer contiguous thereto). In particular, these film stacks commonly comprise alternating layers of high and low refractive index materials. Typically, the high index material has a refractive index of about 2 or more, and the low index material has a refractive index of about 1.9 or less. In certain preferred embodiments, the coating comprises alternating layers of silica (e.g., silicon dioxide), as the low index material, and zirconia (e.g., zirconium dioxide) or titania (e.g., titanium dioxide), as the high index material. While these coatings achieve a particularly pleasing appearance, any conventional dichroic coating can be used.

Preferably, the thickness of each dielectric layer in a dichroic coating is carefully controlled. For example, the optical thickness (i.e., the product of the physical thickness and the refractive index of a given layer) of each dielectric layer is commonly on the order of one quarter of the wavelength of visible light frequencies (e.g., about ¼ the wavelength of a design frequency in the visible spectrum). Thus, the dichroic particles preferably comprise a dichroic coating including one or more dichroic layers each having an optical thickness ranging between about 95 nm and about 187.5 nm. Various patterns of these thicknesses produce different colors and different saturations of the dichroic particles. These arrangements cause light to be selectively reflected or transmitted as a function of wavelength. Dichroic filters of this nature are well known in the present art. When these arrangements are used, the dichroic particles appear to change in color when viewed from different angles, in a manner similar to natural opal, fire obsidian, mother of pearl, fire agate, etc.

Thus, the dichroic particles create a play-of-color in the gemstone material. In more detail, the dichroic layers produce multiple internal reflections. Some of these reflections add together constructively producing vibrant reflected colors. Others add together constructively in the transmitted direction producing rich transmitted colors. The resulting dichroic filter reflects some wavelengths and transmits others. By varying the thicknesses of the layer(s), different colors can be created. When viewed from different angles, the colors change, creating an exceptional play-of-color effect.

The dichroic coating may also include absorbing layers. For example, the coating may comprise various metallic layers in conjunction with the dielectric layer(s). In certain embodiments, the coating comprises a Fabry-Pierot filter. Colored layers can also be incorporated into the coating to further modify its appearance.

As noted above, the dichroic particles can be particles (e.g., flakes) of dichroic film. In some cases, the dichroic particles are glass, crystal, or plastic particles (e.g., granules) bearing a dichroic film. For example, the dichroic particles can be particles of crushed dichroic-coated glass or crystal. Crushed dichroic particles can be obtained by crushing a substrate (e.g., a sheet of glass or crystal) bearing a dichroic coating, as described below.

In certain embodiments, the dichroic particles in the gemstone material are present in a specific (e.g., predetermined) size distribution. By using a batch of particles having a specific size distribution, the gemstone material is given a specific appearance. The specific appearance that corresponds to any specific particle size distribution can be produced on a repeatable basis. Thus, in certain embodiments, the dichroic particles are present in the gemstone material in a repeatable particle size distribution. This allows the manufacturer to repeatedly use a known particle size distribution to reproduce a desired, known appearance. Further, different manufacturers can produce a desired, known appearance by using the same known particle size distribution. Thus, the present gemstone material is also reproducible. In embodiments involving crushed dichroic particles of a specific size distribution, the film particles 10 that end up in the gemstone material have a corresponding size distribution. It will be appreciated that the present gemstone material can be fashioned into a plurality of products each having the same general appearance and yet each being unique.

In certain embodiments, the gemstone material has a uniform particle size distribution. That is, a particle size distribution that is substantially uniform across all regions of the vitreous material in which the dichroic particles are embedded. This can yield a uniform color effect. Alternatively, the particles can be present in the gemstone material in a wide variety of size-distribution patterns. This can yield a variety of striking effects. Thus, the dichroic particles can also be disposed in the gemstone material in a repeatable size-distribution pattern. A great many patterns of this nature can be used to achieve a myriad of effects.

In certain embodiments, a first predetermined portion of the dichroic particles in the gemstone material are within a first size range, and a second predetermined portion of the dichroic particles are in a second size range. To achieve a uniform appearance, substantially all regions of the vitreous material in which the dichroic particles are embedded can have a substantially uniform ratio of dichroic particles in the first size range to dichroic particles in the second size range. This, however, is by no means required. For example, this ratio can be varied to achieve various repeatable patterns, as described above. For example, the particles in the first size range can be present in a larger percentage than the particles in the second size range, if so desired.

In certain embodiments, the dichroic particles 10 embedded in the vitreous material are located in at least one layer 20L that extends substantially entirely between the sides 27 of the gemstone material. This is perhaps best appreciated with reference to FIG. 4, wherein each layer 20L of dichroic particles 10 extends entirely between the sides 27 of the slab 20. Thus, in certain faceted gemstone embodiments 30, as well as in certain cab 40 embodiments, the embedded dichroic particles 10 are located in at least one layer 20L that extends entirely between opposed side surface portions of the faceted gemstone 30 or the cab 40. This is not required in all embodiments. However, the present embodiments provide a distinct appearance, which differs from the appearance of material that only has particles embedded in an isolated local area.

In certain embodiments, the vitreous material contains non-dichroic particles in addition to the dichroic particles. Like the dichroic particles, the non-dichroic particles can be included in a repeatable size distribution (e.g., characterized by specific weight percentages of particles in specific size ranges). The inclusion of non-dichroic particles is useful in producing various optical effects in the gemstone material. For example, colored particles can be added to achieve various effects. Further, particles of different refractive index can be added to produce desirable optical effects. In particular, particles of colloidal size (e.g., having a major dimension of less than 0.2 microns) of a desired material, such as colloidal silica, can be added to the gemstone material to produce an opalescent effect. An opalescent effect can also be produced by crystallization of one of the components of the substrate during cooling or processing. For example, lithium components added to glass in appropriate amounts would crystallize during cooling to give an opalescent appearance. It is generally preferred to have only a small degree of opalescence in the gemstone material so as not to overwhelm the dichroic colors. There are countless combinations of dichroic and non-dichroic particles that can be used, each yielding a unique optical effect. Since individual preferences vary, any number of different size ranges and percentages of dichroic and/or non-dichroic particles can be used.

In certain embodiments, the gemstone material has a black opal appearance. These embodiments commonly incorporate black glass into the gemstone material. For example, the gemstone material can comprise a bottom substrate (or base portion) of black glass (or another black substrate). One embodiment of this nature is exemplified in FIG. 5, wherein the illustrated slab 20 has a base portion 20B comprising black glass or black crystal, an upper portion 20U comprising clear glass or clear crystal, and a layer 20L comprising dichroic particles between the upper portion 20U and the base portion 20B. If so desired, the gemstone material can be produced by including particles of black glass. Incorporating black glass into the gemstone material advantageously highlights, and enhances the contrast of, the dichroic film particles.

In certain preferred embodiments, the dichroic particles in the gemstone material are disposed in a substantially uniform orientation. By arranging the dichroic particles in a substantially uniform orientation, the gemstone is made to exhibit maximum brilliance and play-of-color. Preferably, the substantially uniform orientation is characterized by particles having respective major surfaces oriented in a substantially common direction. This can be appreciated with reference to FIGS. 1-3, wherein the illustrated dichroic particles 10 have major surfaces oriented in substantially common directions. In more detail, the illustrated dichroic particles 10 have first major surfaces 12 oriented in a first common direction and second major surfaces 14 oriented in a second common direction. Here, the first and second common directions are generally opposed (e.g., separated by about 180 degrees). Preferably, the dichroic particles have major surfaces oriented normal (or substantially normal) to a path of incoming light 5. Thus, the dichroic particles preferably have major surfaces oriented normal to a top surface of the gemstone material. The configuration of such top surface depends upon the cut of a given gemstone or decorative article.

In certain embodiments, the gemstone material is provided in the form of a slab. This is perhaps best appreciated with reference to FIG. 1. The slab 20 has first 22 and second 24 generally-opposed major surfaces. The slab 20 commonly has a thickness (i.e., the dimension between surfaces 22 and 24) ranging between about ¼ inch and about ½ inch, although any desired slab thickness can be used. The dichroic particles 10 in the slab 20 preferably are arranged in a substantially uniform orientation. As shown in FIG. 1, the dichroic particles 10 are preferably arranged so as to have their respective major surfaces 12, 14 oriented substantially parallel to the major surfaces 22, 24 of the slab 20. The dichroic particles 10 are thus arranged to have their first major surfaces 12 oriented in a substantially common direction, e.g., normal to a path 5 of incoming light (and/or generally parallel to the top surface 22 of the slab 20).

The dichroic particles 10 embedded in the gemstone material can be located in one or more layers. This is perhaps best appreciated with reference to FIG. 5, which exemplifies an embodiment wherein a single layer 20L of dichroic particles is provided. This can be accomplished by positioning dichroic particles in a single layer between two substrates. When multiple layers 20L are desired, dichroic particles 10 can be positioned in a plurality of layers 20L each sandwiched between two substrates. This is perhaps best appreciated with reference to FIG. 4, wherein three layers 20L of dichroic particles are provided.

Figure 4:
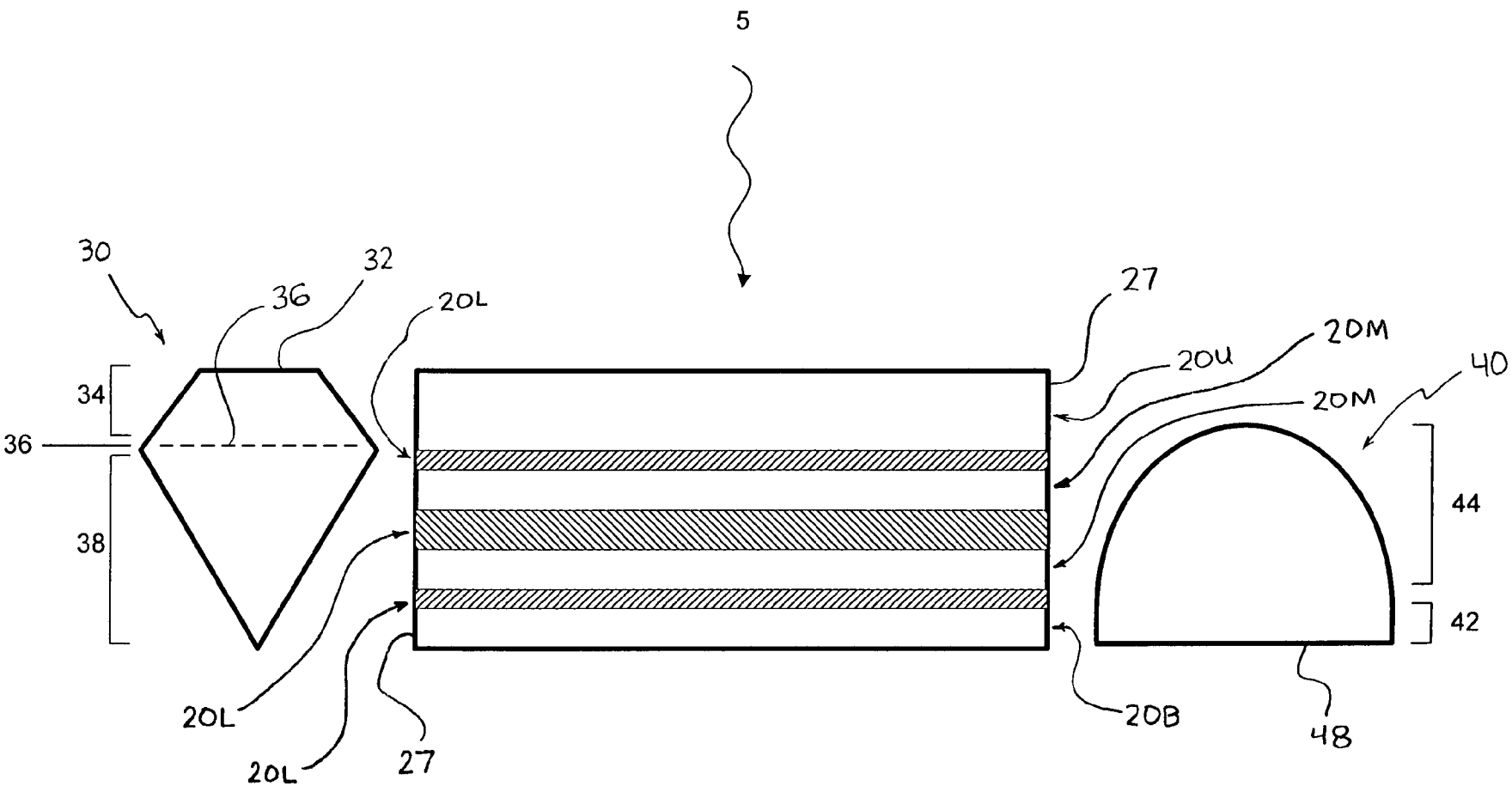
FIG. 4 is a schematic illustration of the manner in which faceted gemstones and cabochons are cut from a slab of the gemstone material in accordance with certain embodiments.

When the gemstone material is provided in the form of a slab 20, each layer 20L preferably is substantially parallel to the major surfaces 22, 24 of the slab. Further, each layer 20L preferably is located in a central thickness of the slab 20. In FIG. 4, the dichroic particles are arranged in three layers 20L each being substantially parallel to the major surfaces 22, 24 of the slab 20. In certain embodiments, each layer 20L extends entirely between generally-opposed sides 27 of the slab 20, as is perhaps best appreciated with reference to FIG. 4. The interlayers 20M can be formed by clear glass sheets, and/or clear glass particles can be layered alternately with layers of dichroic particles.

Figure 5:
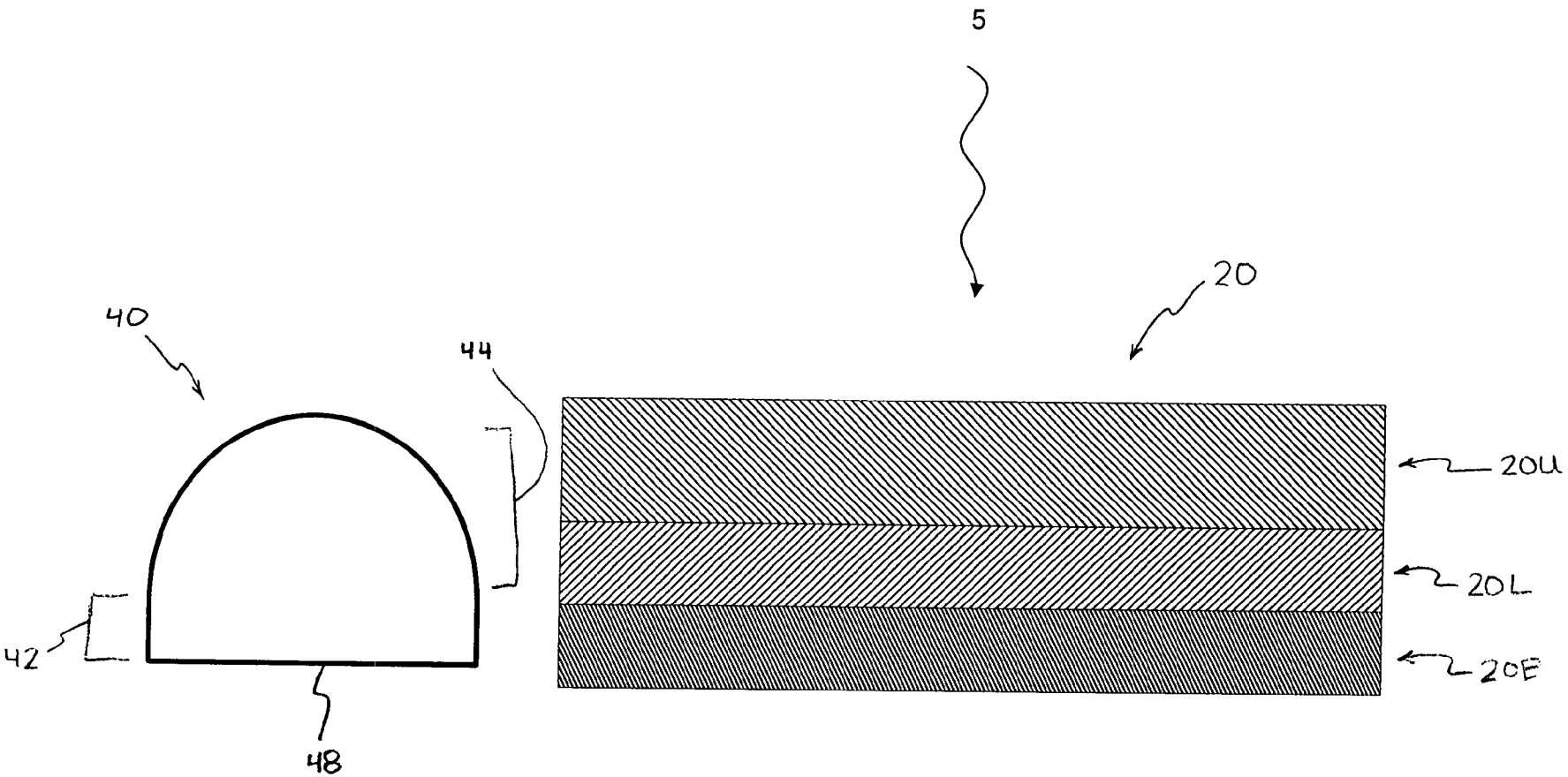
FIG. 5 is a schematic illustration of the manner in which cabochons are cut from a slab of the gemstone material in accordance with certain embodiments.
Figure 6:
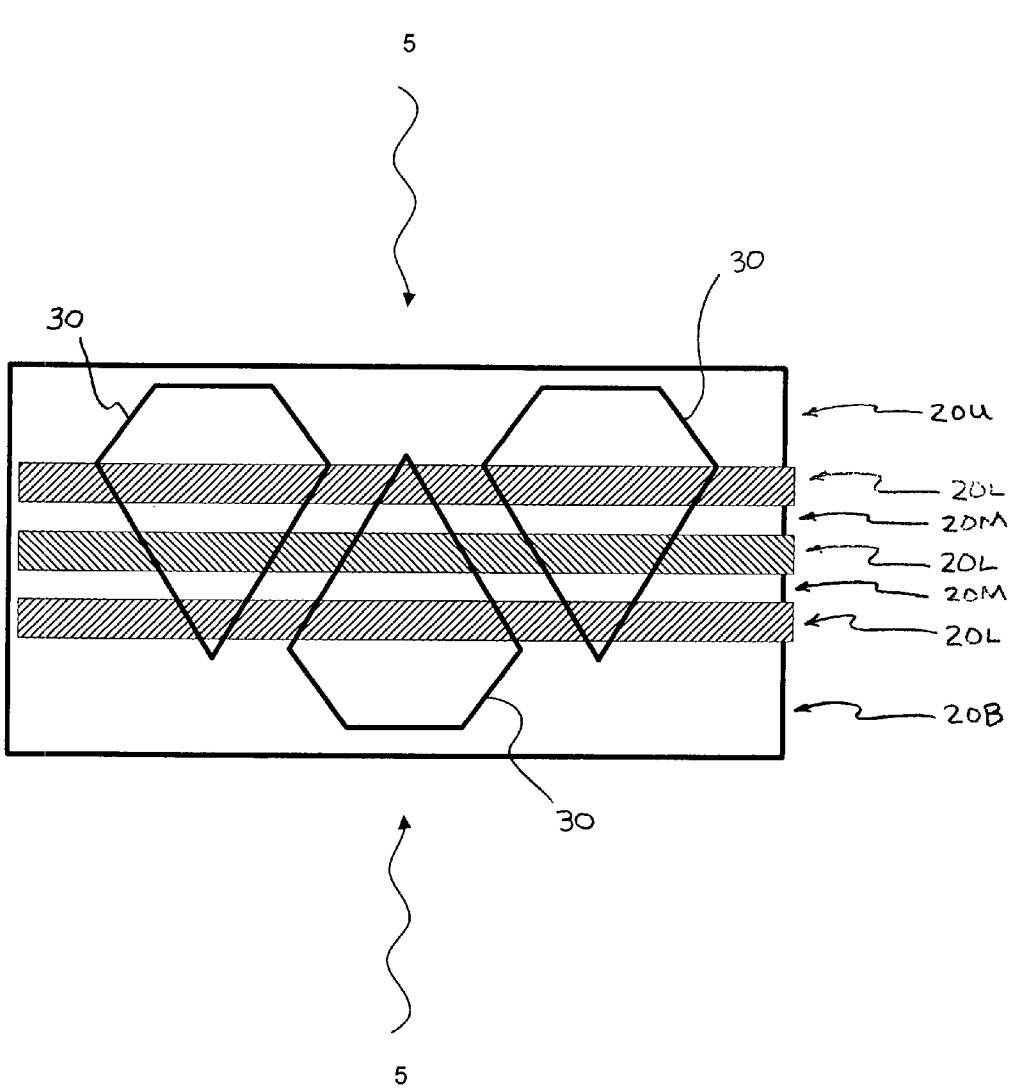
FIG. 6 is a schematic illustration of the manner in which faceted gemstones are cut from a slab of the gemstone material in accordance with certain embodiments.

With reference to FIGS. 4-6, it can be appreciated that the slab 20 can be cut into faceted gemstones 30, cabochons 40, or any other decorative article. Generally speaking, any conventional lapidary techniques can be used for such cutting. For example, the slab 20 can be cut quite easily using carbide or diamond cutting wheels. When the slab is cut into faceted gemstones or cabochons, the resulting stones or cabs are preferably polished. Any conventional polishing compound can be used, with cerium oxide perhaps being the fastest.

Figure 2:
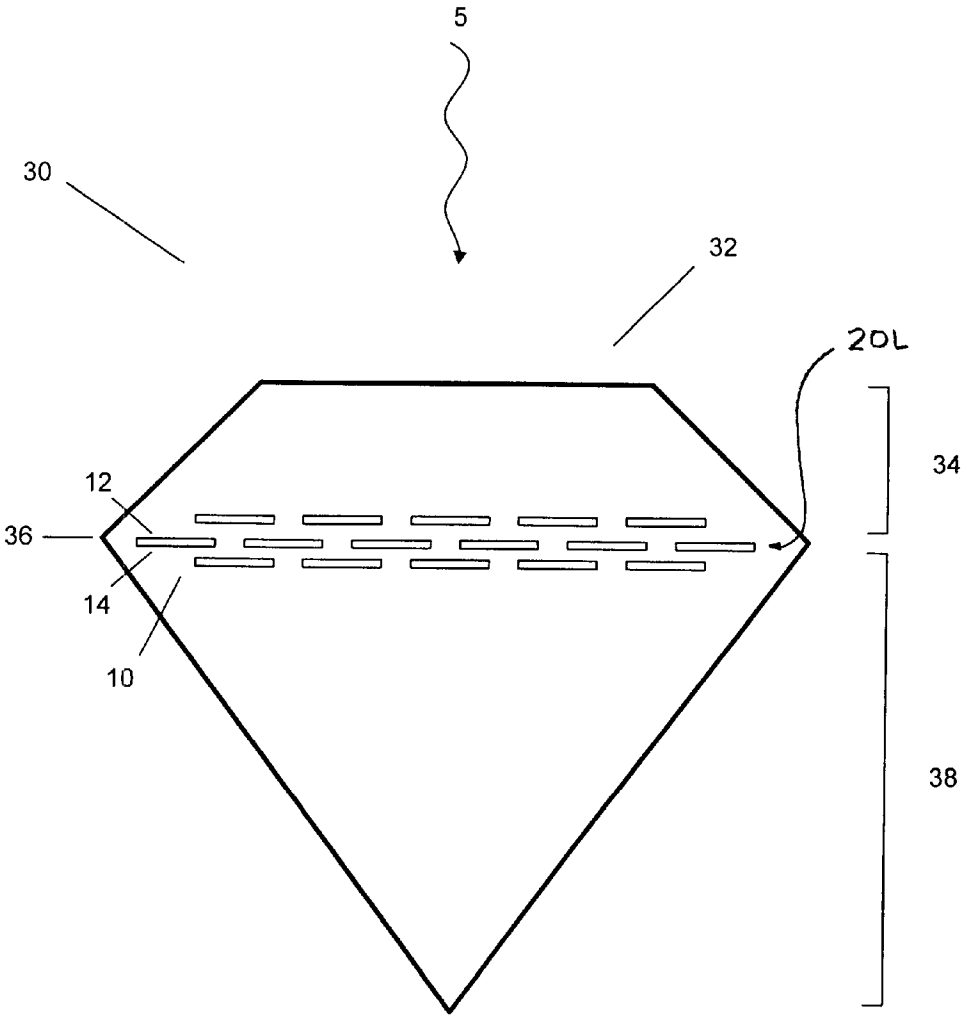
FIG. 2 is a schematic side illustration of the gemstone material of the invention in the form of a faceted gemstone in accordance with certain embodiments.

Thus, in certain embodiments, the gemstone material is provided in the form of a faceted gemstone 30. One embodiment of this nature is depicted in FIG. 2. It is to be understood that the faceted gemstone embodiments are not limited to any particular cut. For example, the faceted gemstone 30 can have a brilliant cut, step cut, Dutch Rose cut, or any other desired cut configuration.

Thus, it will be appreciated that the faceted gemstone 30 can have a crown 34, a pavilion 38, and a girdle 36. Generally, the crown 34 is an upper section of the stone, the pavilion 38 is a lower section of the stone, and the girdle 36 is a rim between the crown and the pavilion. The girdle 36 is typically the widest part of the stone. Typically, the top of the crown defines a table 32. Accordingly, the faceted gemstone 30 shown in FIG. 2 has a crown 34, a pavilion 38, a girdle 36, and a table 32.

Preferably, the dichroic particles 10 in the faceted gemstone 30 are arranged (e.g., disposed) in a substantially uniform orientation. In certain embodiments, the faceted gemstone has a table 32 and the substantially uniform orientation is characterized by particles 10 having their respective major surfaces 12, 14 oriented substantially parallel to the table 32. Thus, the dichroic particles have major surfaces oriented in a substantially common direction in these embodiments. In more detail, such dichroic film particles 10 have major surfaces 12 oriented in a substantially common direction, such that these major surfaces 12 are oriented normal to a path 5 of incoming light. This provides maximum brilliance and an exceptional play-of-color.

The dichroic particles 10 in the faceted gemstone 30 preferably are located in one or more layers 20L. In some embodiments of this nature, each layer 20L extends entirely to at least one surface of the faceted gemstone 30. In some cases, the dichroic particles 10 are located in one or more layers 20L each being substantially parallel to a table 32 and/or a girdle 36 of the gemstone 30. The dichroic film particles 10 in each such layer 20L preferably have respective major surfaces 12, 14 that are substantially parallel to a table 32 and/or a girdle 36 of the faceted gemstone 30.

The dichroic particles 10 in each faceted gemstone 30 can be located in a plurality of layers 20L of which a top layer is nearest the table 32. Preferably, the top layer is substantially parallel to, and substantially aligned with, the girdle 36 of the faceted gemstone 30. Each faceted gemstone 30 can be advantageously cut from a slab 20 in this manner.

Figure 3:
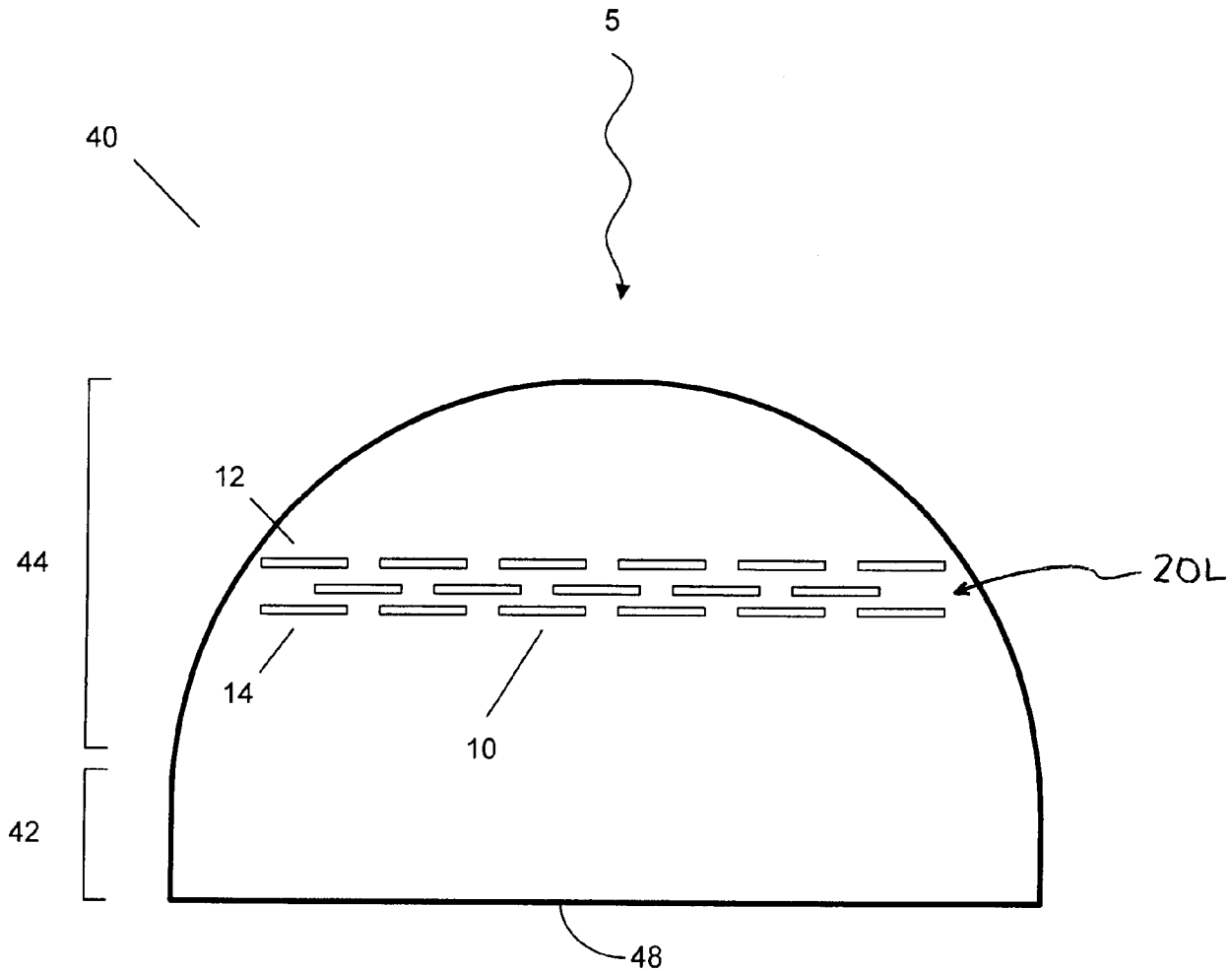
FIG. 3 is a schematic side illustration of the gemstone material of the invention in the form of a cabochon in accordance with certain embodiments.

In certain embodiments, the gemstone material is provided in the form of a cabochon (i.e., a cab). FIG. 3 exemplifies embodiments of this nature. Preferably, the dichroic particles 10 in the cab are arranged in a substantially uniform orientation. In FIG. 3, the cab 40 has a base 48, a base portion 42, and a dome portion 44, while the substantially uniform orientation of the dichroic film particles 10 is characterized by particles 10 having their respective major surfaces 12, 14 oriented substantially parallel to the base 48 of the cab. In the present cab embodiments, the dichroic particles 10 are preferably located in one or more layers 20L each being substantially parallel to the base 48 of the cab. Embodiments of this nature achieve exceptional brilliance and an extraordinary play-of-color. In certain cab embodiments, each layer 20L extends entirely to at least one surface of the cab 40.

The invention also provides methods of producing the gemstone material. In certain embodiments, the method includes providing a laminate comprising a plurality of dichroic particles sandwiched between two sheet-like substrates and heating the laminate to an elevated temperature such that the dichroic particles become fused between the substrates. In certain favored methods, the laminate is maintained under a vacuum during at least a period of the heating, as described below. Moreover, in certain embodiments, the method further comprises allowing the laminate to cool (following the heating) for a desired cooling period, and exposing the laminate to a positive pressure (e.g., a substantially atmospheric pressure or a super-atmospheric pressure) during at least a portion of this cooling period.

Generally, the providing of the laminate comprises positioning the plurality of dichroic particles between the two substrates. The dichroic particles 10 are layered between the substrates. The dichroic particles can simply be distributed over the top major surface of one of the substrates (e.g., in a layer spanning the whole top surface), whereafter the second substrate can be positioned on top of these dichroic particles, such that the dichroic particles are sandwiched between the two substrates. If desired, non-dichroic particles can also be distributed between the substrates, as noted above.

In certain embodiments, the dichroic particles are distributed in a uniform size distribution. In some cases, a first layer of particles in a first size range (or size distribution) is distributed over the top surface of an underlying substrate, and thereafter a second layer of particles in a second, different size range (or size distribution) is distributed over the first layer of particles. Thus, differently sized particles may be overlain on top of each other, if so desired. Further, different dichroic particle mixtures may be overlain upon each other and laminated between clear and/or colored glass particles. As noted above, the particles may be applied in various patterns (e.g., repeatable patterns) of size and color to achieve a variety of striking appearances.

The gemstone material is not limited to being formed with only two substrates. Rather, any desired number of substrates can be provided, with dichroic particles being laminated between at least two of the substrates. Likewise, the substrates can be clear or colored. Combinations of clear and colored substrates can also be used. In certain embodiments, the gemstone material includes at least one black substrate (e.g., a sheet of black glass or black crystal), perhaps optimally as the bottommost substrate.

As noted above, the dichroic particles in the gemstone material preferably comprise particles (e.g., flakes) of dichroic film. In certain embodiments, the dichroic particles are crushed dichroic particles. For example, the crushed dichroic particles can be granules of crushed glass, crystal, or plastic bearing dichroic film. Thus, the providing of the laminate may comprise providing crushed dichroic particles and positioning a plurality of the crushed dichroic particles between the substrates.

If so desired, crushed dichroic particles can be provided by providing a substrate (e.g., glass or crystal sheet) bearing a dichroic coating and crushing the thus-coated substrate. Good results have been obtained by crushing the substrate in a conventional high-speed hammer mill. However, any conventional crushing method can be used. The substrate can be crushed into particles having a wide range of different sizes. For example, these particles can range from very large particles (meter sized) to very small particles, such as fine powder (micron sized). Generally speaking, larger particles are preferred for larger finished articles, although personal preferences will vary.

If so desired, a substrate bearing a dichroic coating (e.g., dichroic-coated glass) can be provided by depositing the dichroic coating upon the substrate. This can be done by depositing any desired dichroic coating (as described above) upon a desired substrate. The dichroic coating can be applied by sputtering, C.V.D., evaporation, wet processes, or any other conventional thin film deposition process.

In certain preferred methods, the crushed dichroic particles are separated according to size. Various methods can be used for separating the particles by size. For example, the crushed dichroic particles can be separated quite advantageously using sieves (e.g., U.S. Standard Series sieves). In some cases, a series of sieves each having differently sized openings are stacked together such that the crushed dichroic particles will pass through the openings of each sieve until they reach a sieve having openings through which they cannot pass. For example, particles that pass through a U.S. Standard number 6 sieve, but are retained by a U.S. Standard number 8 sieve, may be collected in one group, while particles that pass through a U.S. Standard number 10 sieve, but are retained by a U.S. Standard number 12 sieve, may be collected in another group. Thus, the crushed dichroic particles can be separated into different groups by moving the crushed dichroic particles through one or more sieves. Other methods can also be used to separate the crushed dichroic particles into groups of differently-sized particles.

In addition to separating the crushed dichroic particles into different groups characterized by different particle size ranges, the separated particles can also be categorized by size. For example, particles that pass through a U.S. Standard number 6 sieve, but are retained by a U.S. Standard number 8 sieve, may be collected and labeled #8. Similarly, particles that pass through a U.S. Standard number 10 sieve, but are retained by a U.S. Standard number 12 sieve, may be collected and labeled #12.

In certain embodiments, once the crushed dichroic particles have been separated according to size, the particles are recombined to achieve a group of particles having a desired particle size distribution. For example, one may combine 30% by weight #8 particles with 70% by weight #12 particles. The resulting mixture can then be distributed between two or more substrates. Using a known mixture of dichroic particles having a specific size distribution allows a specific appearance to be repeatedly produced. Thus, in certain methods, the crushed dichroic particles are separated into different groups characterized by different particle size ranges, whereafter at least some particles from different groups are combined in a desired particle size distribution (i.e., to produce a group of size-classified particles). As described below, the resulting size-classified particles can then be positioned between at least two substrates to form a laminate, and the laminate can then be heated to fuse the particles between the substrates.

As noted above, non-dichroic particles can optionally be included in the mixture to further enhance a specific optical effect. For example, colored particles can be added to create different color appearances. Since personal preferences vary in the appearance of gemstone material, any combination of sizes and percentages of dichroic and/or non-dichroic particles can be used to create desired appearances. The color effects produced in a given final product are highly reproducible, i.e., the effects can be recreated by using the same combination (or recipe) of particle sizes, percentages, distribution arrangement (or patterns), etc.

As noted above, the dichroic and/or non-dichroic particles are layered and laminated in between at least two sheet-like substrates. In certain embodiments, the substrates are glass or crystal sheets. As noted above, the bottommost substrate can be a layer of black glass, if so desired. Black glass can be used to create a black opal appearance, to highlight the dichroic film, and to enhance the contrast of the dichroic particles. The particles can be layered in many different ways to create many different effects. As noted above, differently-sized particles can be overlain on top of each other, and/or the particles can be layered in patterns of size and color for striking effects.

Once the dichroic particles are sandwiched between the substrates, the resulting laminate is heated to fuse the dichroic particles between the substrates (i.e., to fuse the substrates together such that the dichroic particles are embedded therebetween). In certain embodiments, the substrates are glass or crystal sheets and the laminate is heated to an elevated temperature of between about 600 degrees Celsius and about 850 degrees Celsius. Preferably, the heating of the laminate brings the substrates to a softened state and causes the substrates to become fused together with the dichroic particles therebetween.

As noted above, the laminate is heated under a vacuum in certain embodiments. In more detail, the laminate in these embodiments is maintained under a vacuum during at least a period of the heating. For example, the heating may be carried out in a vacuum chamber equipped with vacuum pumps adapted to create a desired vacuum pressure in the chamber. In certain methods, the laminate (during at least a period of the heating) is maintained under a vacuum of between about 100 torr and about 0.000001 torr, perhaps more preferably between about 1 torr and about 0.00001 torr, and perhaps optimally between about 0.001 torr and about 0.0001 torr.

Following the heating, the laminate is allowed to cool for a desired cooling period. In certain preferred embodiments, the laminate is exposed to substantially atmospheric (i.e., substantially ambient) pressure or super-atmospheric pressure during at least a portion of the cooling period. This collapses air bubbles in the laminate, resulting in a gemstone material that is substantially free of air bubbles (e.g., has no readily visible air bubbles). In certain methods, the laminate is exposed to a substantially atmospheric or super-atmospheric pressure by venting the vacuum chamber (in which the laminate is being processed) to an ambient pressure (i.e., to an ambient atmosphere). In other methods, the laminate is exposed to a substantially atmospheric or super-atmospheric pressure by delivering pressurized gas into the vacuum chamber. In some cases, the laminate is exposed to a pressure that is below ambient pressure yet is sufficient to collapse air bubbles. In certain embodiments, the laminate is exposed to a positive pressure of greater than about 100 torr, preferably greater than about 300 torr, and perhaps optimally greater than about 600 torr.

Thus, the laminate can be exposed to a positive pressure (preferably a substantially atmospheric pressure or a super-atmospheric pressure) during at least a portion of the cooling period. Preferably, the heating of the laminate (e.g., which may comprise glass and/or crystal substrates) brings the laminate to a softened state, and the laminate is exposed to the positive pressure before the laminate (e.g., the glass and/or crystal) cools to a hardened state. Thus, the laminate preferably is exposed to a positive pressure while the laminate is still far above room temperature (and is in a softened state). In certain methods, the laminate comprises glass or crystal substrates and the laminate is exposed to the positive pressure before the glass or crystal substrates cool to a temperature below about 600 degrees Celsius. For example, the laminate can be advantageously exposed to the positive pressure while the glass or crystal substrates are at a temperature of between about 600 degrees Celsius and about 800 degrees Celsius.

In certain embodiments, the laminate is heated by performing a series of heating operations. Preferably, the heating operations are computer-controlled. In one such series of operations, the laminate is placed inside a vacuum chamber and the chamber is closed but kept at an ambient pressure. The temperature is slowly raised from room temperature to about 300 degrees Celsius at a rate of about 50 degrees Celsius per hour. This temperature is then maintained for the time required for the vacuum pumps to achieve a baseline pressure of less than about 0.0001 torr. After this pressure has been achieved, the temperature is raised to about 720 degrees Celsius at a rate of about 30 degrees Celsius per hour. The temperature is then maintained at about 720 degrees Celsius for about two hours to allow equilibrium of the melt.

Once the laminate has become completely fused, it is allowed to slowly cool to room temperature. In some cases, this is accomplished by simply removing the laminate from the chamber (and exposing it to an ambient atmosphere while allowing the laminate to cool). In other embodiments, this is accomplished by lowering the temperature in the chamber at a rate of about 20 degrees Celsius per hour to minimize thermal shock and associated stresses. If stresses are present, a separate annealing step can optionally be performed.

In certain particularly favored methods, the dichroic particles embedded in the laminate are arranged in a substantially uniform orientation. For example, the dichroic particles can be arranged in a substantially uniform orientation by imparting shear (shear motion, shear gradient, shear force, rotation, etc.) upon the laminate. In certain methods, the shear is imparted upon the laminate during the heating of the laminate and/or during a subsequent cooling period. Preferably, this shear is imparted upon the laminate while it is in a softened stated (i.e., before it has cooled to a hardened state). For example, the laminate can comprise glass and/or crystal substrates and the shear can be imparted upon the laminate while it is at a temperature of between about 600 degrees Celsius and about 800 degrees Celsius. When shear is imparted upon the laminate, it arranges the orientation of the dichroic particles 10. Thus, any method of imparting shear upon the laminate can be used to orient the dichroic particles. As noted above, the orientation of the dichroic particles provides a brilliant appearance with an exceptional play-of-color.

In certain embodiments, the dichroic particles 10 are oriented by a method wherein an upper portion 20U of the laminate is translated with respect to its bottom portion 20B. Preferably, the relative translation is at least several times the thickness of the laminate.

In certain preferred embodiment, the dichroic particles 10 are oriented by rotating the laminate while it is in a softened state. In one embodiment, the laminate is processed in a chamber having a rotating table (e.g., a spinner) that holds the laminate during heating. For example, the rotating table can comprise a sheet (e.g., a ceramic sheet) provided with a shaft (e.g., a ceramic shaft) and a rotary vacuum feed-through. After heating, the rotating table can be spun at a constant speed, for example by a servo motor. When the softened laminate is spun on the rotating table, a shear gradient is established, causing the dichroic particles to orient in a common direction. The rotating table is advantageously rotated (spun) for a sufficient time to reduce the thickness of the laminate by a factor of about three (a phenomenon similar to tossing pizza dough). In some cases, the spinning of the table is performed while the laminate is still under a vacuum. The inventors have discovered it to be suitable to spin a glass and/or crystal laminate at about 42 RPM for a period of about six minutes after fusing has taken place but before the laminate is exposed to substantially atmospheric pressure or super-atmospheric pressure.

Table 4 below exemplifies features of certain favored methods of the invention.

TABLE 4

| Process | Form silica micro-spheres | Precipitate silica into pseudo-crystal | Impregnation | Coat dichroic onto substrate | Crush dichroic | Fuse or sinter at high temperature | Polymerize plastic at low temperature | Fabricate into gem (lapidary) |
|---|---|---|---|---|---|---|---|---|
| Certain favored methods of the present invention | No | No | No | Yes | Yes | Fuse in vacuum then vent to air | No | Yes |

Once a slab 20 of the gemstone material is cooled, the slab can be fabricated (e.g., cut) into faceted gemstones, cabs, or any other decorative article using conventional lapidary and glass working techniques. Certain manners of cutting the slab 20 into faceted gemstones 30 and cabs 40 are exemplified in FIGS. 4-6.

While preferred embodiments of the present invention have been described, it should be understood that a variety of changes, adaptations, and modifications can be made therein without departing from the spirit of the invention and the scope of the appended claims.

What is claimed is:

1. A method of producing gemstone material, the method comprising:

a) providing a laminate comprising a plurality of dichroic particles sandwiched between two sheet-like substrates;

b) heating the laminate under vacuum to an elevated temperature of between about 600 degrees Celsius and about 850 degrees Celsius, such that the plurality of dichroic particles become fused between the sheet-like substrates, thereby producing a slab of the gemstone material, the method comprising arranging the plurality of dichroic particles in a substantially uniform orientation, wherein the plurality of dichroic particles are arranged in said uniform orientation by imparting shear upon the laminate; and;

c) cutting the slab into a plurality of faceted gemstones or cabochons.

2. The method of claim 1 wherein following said heating, the laminate is allowed to cool for a desired cooling period, and the laminate is exposed to substantially atmospheric pressure or super-atmospheric pressure during at least a portion of the cooling period.

3. The method of claim 2 wherein said heating is carried out in a vacuum chamber, and the laminate is exposed to said substantially atmospheric pressure or super-atmospheric pressure by venting the vacuum chamber to an ambient atmosphere and/or by delivering pressurized gas into the vacuum chamber.

4. The method of claim 2 wherein said substrates comprise glass or crystal sheets and said heating brings the glass or crystal sheets to a softened state, and wherein the laminate is exposed to said substantially atmospheric pressure or super-atmospheric pressure before the glass or crystal sheets cool to a hardened state.

5. The method of claim 4 wherein the laminate is exposed to said substantially atmospheric pressure or super-atmospheric pressure while the glass or crystal sheets are in the softened state.

6. The method of claim 4 wherein the laminate is exposed to said substantially atmospheric pressure or super-atmospheric pressure before the glass or crystal sheets cool to a temperature below about 600 degrees Celsius.

7. The method of claim 6 wherein the laminate is exposed to said substantially atmospheric pressure or super-atmospheric pressure while the glass or crystal sheets are at a temperature between about 600 degrees Celsius and about 850 degrees Celsius.

8. The method of claim 1 wherein the laminate is maintained under a vacuum of between about 100 torr to about 0.000001 torr. during at least a period of said heating.

9. The method of claim 8 wherein the laminate is maintained under a vacuum of between about 1 torr. and about 0.0000 1 torr. during at least a period of said heating.

10. The method of claim 9 wherein the laminate is maintained under a vacuum of between about 0.00 1 torr. and about 0.000 1 torr. during at least a period of said heating.

11. The method of claim 1 wherein the providing of the laminate comprises positioning the plurality of dichroic particles between the two sheet-like substrates.

12. The method of claim 1 wherein the plurality of dichroic particles comprises crushed dichroic particles, and the providing of the laminate comprises:

providing crushed dichroic particles; and positioning a plurality of the crushed dichroic particles between the two sheet-like substrates.

13. The method of claim 12 wherein the providing of the crushed dichroic particles comprises: providing a glass or crystal sheet bearing a dichroic coating; and crushing the thus-coated glass or crystal sheet.

14. The method of claim 13 wherein the providing of the glass or crystal sheet bearing a dichroic coating comprises depositing the dichroic coating upon the glass or crystal sheet.

15. The method of claim 12 wherein the crushed dichroic particles are separated into different groups characterized by different particle size ranges, whereafter at least some particles from different groups are combined in a desired particle size distribution to form said plurality of the crushed dichroic particles.

16. The method of claim 15 wherein the crushed dichroic particles are separated into different groups by moving the crushed dichroic particles through one or more sieves.

17. The method of claim 1 wherein the shear is imparted upon the laminate during said heating and/or during a subsequent cooling period.

18. The method of claim 1 wherein the shear is imparted upon the laminate while the laminate is at a temperature of between about 600 degrees Celsius and about 850 degrees Celsius.

19. The method of claim 1 wherein each faceted gemstone or cabochon is cut from the slab so as to have at least one layer of the dichroic particles, wherein each such layer is substantially parallel to a table and/or a girdle of such faceted gemstone or is substantially parallel to a base of such cabochon.

20. A method of producing gemstone material, the method comprising:

a) providing a laminate comprising a plurality of dichroic particles sandwiched between two glass or crystal sheet-like substrates;

b) heating the laminate to an elevated temperature such that the plurality of dichroic particles become fused between the sheet-like substrates, the method comprising arranging the plurality of dichroic particles in a substantially uniform orientation, wherein the laminate is rotated to arrange the plurality of dichroic particles in said substantially uniform orientation.

21. The method of claim 20 wherein the laminate is rotated by placing the laminate on a spinner and spinning the spinner.

22. The method of claim 20 wherein at least one of the glass or crystal sheet-like substrates is black glass or black crystal.

23. A method of producing gemstone material, the method comprising:

a) providing two sheet-like substrates;

b) providing a plurality of dichroic particles;

c) separating at least some of the dichroic particles into different groups characterized by different particle size ranges;

d) combining at least some particles from the different groups in a desired particle size distribution to produce size-classified particles;

e) positioning a plurality of the size-classified particles between the two sheet-like substrates to form a laminate; and f) heating the laminate under vacuum to an elevated temperature of between about 600 degrees Celsius and about 850 degrees Celsius, such that said plurality of the size-classified particles become fused between the sheet-like substrates, wherein said heating brings the laminate to a softened state the method comprising arranging the plurality of dichroic particles in a substantially uniform orientation by imparting shear upon the laminate while the laminate is in the softened state.

24. The method of claim 23 wherein following said heating, the laminate is allowed to cool for a desired cooling period, and the laminate is exposed to substantially atmospheric pressure or super-atmospheric pressure during at least a portion of the cooling period.

25. A method of producing gemstone material, the method comprising:

a) providing two sheet-like substrates;

b) providing a plurality of dichroic particles;

c) separating at least some of the dichroic particles into different groups characterized by different particle size ranges;

d) combining at least some particles from the different groups in a desired particle size distribution to produce size-classified particles;

e) positioning a plurality of the size-classified particles between the two sheet-like substrates to form a laminate; and f) heating the laminate under vacuum to an elevated temperature of between about 600 degrees Celsius and about 850 degrees Celsius, such that said plurality of the size-classified particles become fused between the sheet-like substrates, wherein said heating brings the laminate to a softened state, the method comprising arranging the plurality of dichroic particles in a substantially uniform orientation by imparting shear upon the laminate while the laminate is in the softened state, and wherein following said heating, the laminate is allowed to cool for a desired cooling period, and the laminate is exposed to substantially atmospheric pressure or super-atmospheric pressure during at least a portion of the cooling period.

* * * * *